United States Patent [19]

Pototsky

[11] 3,986,567

[45] Oct. 19, 1976

[54] HYDRAULIC PERCUSSIVE-ROTARY MACHINE

[76] Inventor: Vasily Borisovich Pototsky, ulitsa 4 Linia 208, Alma-Ata, U.S.S.R.

[22] Filed: Dec. 8, 1975

[21] Appl. No.: 638,976

[52] U.S. Cl. ..... 173/108; 173/137; 91/189; 91/303

[51] Int. Cl.[2] ..... E21C 3/00

[58] Field of Search ..... 173/108, 119, 137; 91/189, 303

[56] References Cited

UNITED STATES PATENTS

| | | | |
|---|---|---|---|
| 2,457,969 | 1/1949 | Anderson | 91/189 X |
| 2,734,488 | 2/1956 | Wampach | 173/108 X |
| 3,141,384 | 7/1964 | Hoffman | 91/189 X |
| 3,587,753 | 6/1971 | Feucht | 173/108 X |

FOREIGN PATENTS OR APPLICATIONS

| | | | |
|---|---|---|---|
| 368,060 | 9/1906 | France | 173/108 |

*Primary Examiner*—Ernest R. Purser
*Assistant Examiner*—Richard E. Favreau
*Attorney, Agent, or Firm*—Lackenbach, Lilling, & Siegel

[57] ABSTRACT

A machine having a housing wherein are arranged a hammer piston adapted for reciprocation in said housing to effect forward and return strokes and a stepped pressure difference ring valve fitted over the hammer piston and also reciprocating in said housing. A tool rotation mechanism is linked kinematically with a gear arranged on an anvil and has at least one twin hydraulic cylinder comprised of two different diameter cylinders and located at the front portion of the machine. The twin hydraulic cylinder is divided by a lateral partition and accommodates a pusher piston which carries a spring-loaded pawl and forms with the partition and the different diameter cylinder barrels two chambers, the smaller diameter chamber being the pressure one, the larger diameter chamber being the return chamber. At the point of location of the ring valve having an outer annular groove, the machine housing is provided with three inner annular grooves with passages of which the front groove as in the direction of drilling, constantly communicates with the atmosphere, the middle groove constantly communicates with the larger diameter chamber and the rear groove communicates with the lower diameter chamber of the twin hydraulic cylinder and with the pressure pipeline. The above grooves of the housing and the chambers of the twin hydraulic cylinder are so interconnected that reciprocations of the ring valve cause the pusher piston to effect the forward and return strokes thus kinematically interacting via the pawl with the gear during a return stroke of the hammer piston.

2 Claims, 10 Drawing Figures

HYDRAULIC PERCUSSIVE-ROTARY MACHINE

The present invention relates to a hydraulic percussive-rotary machine which may be used for drilling holes and deep wells in mining, tunelling, construction work and the like.

In the art is known a hydraulic percussive-rotary machine for drilling holes and wells, comprising: a housing with passages for fluid and a stepped hammer piston adapted to move axially in said housing and adjoining with its larger diameter step the front portion of the machine. The piston hammer is pressed by a cylindrical spring against the front portion of the machine and is reciprocated by the pressure of fluid to effect forward and return strokes. During its forward strokes the hammer piston applies impacts to an anvil of a tool installed in the housing at the front portion of the machine.

The known hydraulic machine is provided with a stepped pressure difference ring valve fitted over the hammer piston and reciprocating to distribute the fluid between the return space and the atmosphere.

To turn the tool, the machine has a tool rotation mechanism linked kinematically with a gear mounted on the anvil.

The stepped hammer piston of the known hydraulic percussive-rotary machine is made as an integral part with two steps of different diameters, a smaller area end face of the hammer piston step being in the rear portion space of the housing which is in constant communication with the pressure pipeline. With the ring valve being in the foremost position (in the direction of drilling), its passages communicate with the passages in the housing whereby the return space is connected to the pressure pipeline. The pressure fluid enters the return space and effects a return stroke of the hammer piston compressing a spring arranged between the head face of the hammer piston larger diameter step and an annular projection of the housing. At the end of the return stroke the hammer piston touches the inner annular projection of the valve by its outer annular projection and separates the valve from the anvil which causes the valve, due to the difference in the end face areas, to move backward under the action of the fluid away from the tool thus opening the discharge passages. The valve passages are sealed off by the side cylindrical walls of the housing and the return space is disconnected from the pressure pipeline thus resulting in a hydraulic shock above the hammer piston and in the pressure pipeline. The combined action of the hydraulic shock, excess pressure of the fluid against the hammer piston smaller diameter step end face and of the releasing spring makes the hammer piston accomplish the forward stoke expelling the fluid from the return space outside. At the end of said stroke the hammer piston shifts the valve to the foremost position to shut off the discharge passages and strikes the anvil connected with the tool. The stoppage of the hammer piston results in the second hydraulic shock in the pipeline, said shock plus the fluid excess pressure causing the hammer piston to effect its return stroke and the cycle repeats.

The disadvantage of this hydraulic percussive machine consists in the absence therein of an independent rotary mechanism for rotating the drill bit synchronously with the operation of the hammer piston.

When the hydraulic percussive machine operates on oil, existing high-torque hydromotors (blade, radial piston etc.) can be used for rotating the drill; however, these motors cannot operate on water. Besides, they do not turn the drill synchronously with the operation of the percussive machine hammer piston.

Thus in the prior art there existed no independent drill rotation mechanism to operate synchronously with the hydraulic percussive machine hammer piston both on oil and water. This fact restricts application of hydraulic percussive drilling in mining inspite of advantages thereof, since organizing a centralized high-pressure water pipeline system for actuating hydraulic percussive machines with subsequent dedusting is less complicated than outfitting each of said machines with bulky oil hydraulic drives.

The principle object of the invention is to provide a machine whose tool rotation mechanism operates synchronously with the hammer piston turning the tool during a return stroke of the hammer piston and is reversible to ensure turning of the drilling pipes when making deep wells.

Another object of the invention is to provide a hydraulic percussive-rotary machine having a simple design and being reliable in operation.

Still another object of the invention is to provide a machine with a reduced weight and a minimum number of parts.

These and other objects of the invention are achieved by providing a hydraulic percussive-rotary machine for making holes and deep wells in soil, whose housing having passages for fluid accommodates a stepped hammer piston, said piston adapted to move axially in said housing and to reciprocate to effect forward and return strokes and to apply impacts during the forward strokes against an anvil which mounts a tool, a stepped pressure difference ring valve, said valve fitted over the hammer piston and also adapted to reciprocate for distributing the fluid between the return space and the atmosphere, and a tool rotation mechanism linked kinematically with a gear arranged on the anvil. The tool rotation mechanism, according to the invention, has at least one twin hydraulic cylinder comprised of two different diameter cylinders arranged in the front portion of the machine divided by a lateral partition and accommodating a pusher piston which carries a spring-loaded pawl and forms with the partition and the different diameter cylinder barrel two chambers, the smaller diameter chamber being the pressure chamber, while the larger diameter is the return chamber. At the point of location of said ring valve having an outer annular groove, the housing is provided with three inner annular grooves with passages of which the front groove, as in the direction of drilling, constantly communicates with the atmosphere the middle groove constantly communicates with the larger diameter chamber groove and the rear communicates with the smaller diameter chamber of the twin hydraulic cylinder and with the pressure pipeline so that reciprocations of the ring valve cause the pusher piston to effect the forward and return strokes thus kinematically interacting via the pawl with the gear during a return stroke of the hammer piston.

The hydraulic percussive-rotary machine is preferably provided with at least one additional twin cylinder, said additional twin cylinder being connected with said grooves of the machine housing similarly to the first twin cylinder but arranged at the opposite side of the gear, and with a hydraulic cylinder linked hydraulically with said twin hydraulic cylinder and with the machine housing grooves and adapted to alternatively cut in and out off the twin cylinders to effect reversing of the tool.

The present invention provides a hydraulic percussive-rotary machine for making holes and deep wells in soil having a tool rotation mechanism which operates synchronously with a hammer piston turning the tool during a return stroke of said hammer piston and provides for reversing of the tool that increases the efficiency of the machine due to mechanization of drilling pipes turning when drilling deep wells, said machine being of a simpler design, reliable in operation and having lower weight as compared with the known machines of the same type, minimum number of parts and increased efficiency.

The invention is explained hereinbelow by way of examples with reference to the accompanying drawings, wherein.

Figure 1:
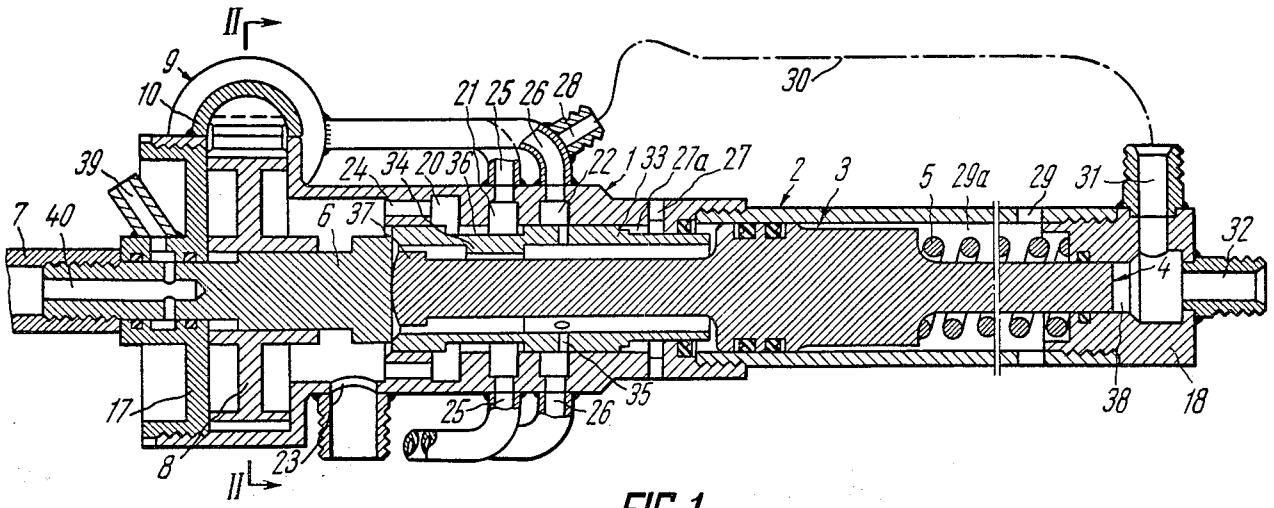
FIG. 1 is a longitudinal sectional view of a hydraulic percussive-rotary machine, according to the invention, with unidirectional drill turning.
Figure 3:
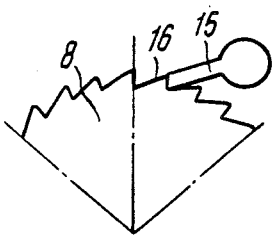
FIG. 3 is one of the possible profiles of a gear of a rotation mechanism shown in FIGS. 1 and 2.
Figure 2:
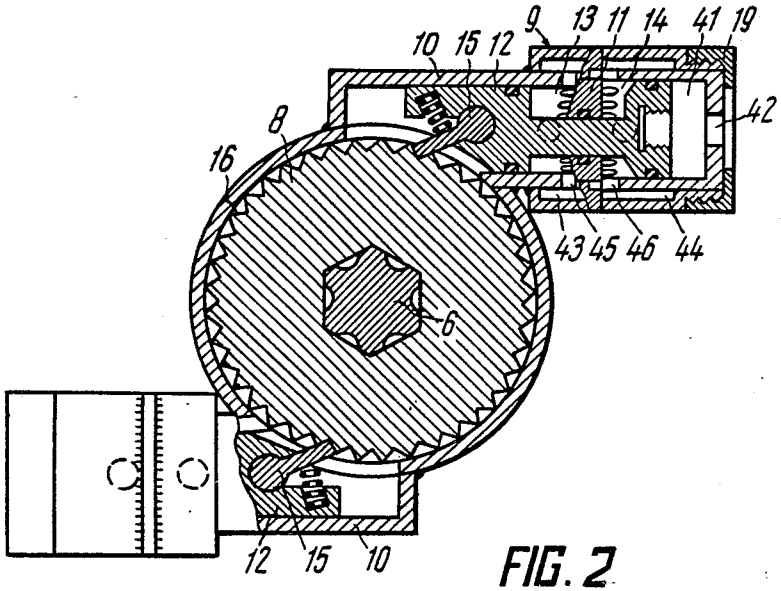
FIG. 2 is a cross sectional view taken along the line II—II of FIG. 1.

A hydraulic percussive-rotary machine shown in FIGS. 1, 2 and 3 has a larger diameter stepped housing 1 adjoining the front portion of the machine and a smaller diameter housing 2 adjoining the rear portion thereof.

The housings 1 and 2 accommodate a stepped hammer piston 3 with a smaller diameter rear portion end face 4, said hammer piston being adapted to reciprocate axially in said housings.

Arranged between the hammer piston 3 and a cover closing the rear part of the housing 2 is a cylindrical compression spring 5 pressing the hammer piston towards the front portion of the machine.

Located in the housing 1 at the machine front portion is an anvil 6 secured to rod 7 whose end mounts a tool.

During operation of the machine, the hammer piston end face directed to the machine front portion applies impacts to the anvil 6 which transmits them to the structure being destroyed via the rod 7 and the tool (not shown).

The front portion of the machine accommodates also a rotation mechanism serving to turn the rod 5 with the tool when drilling the well.

The rotation mechanism has a gear 8 slide fitted on the anvil 6, so the gear 8 and anvil 6 may be movable axially relative to each other and two similar twin cylinders 9. For the sake of briefness only one twin cylinder of the machine is described hereinbelow.

Each twin cylinder 9 has a barrel 10, said barrel divided by a lateral partition 11, and a differential pusher piston 12 which has a thinned middle portion passing through the partition 11 and forming therewith and with the barrel 10 two chambers 13 and 14. The chamber 13 section area is smaller than that of the chamber 14 for a value which is sufficient only to effect a return stroke of light-weight small-size pusher pistons 12. This increases the machine efficiency.

The pusher piston 12 has a spring-loaded pawl 15 meshed with teeth 16 of the gear 8 in the course of the forward stroke to turn the anvil 6 with the rod 7 and the tool.

The housings 1, 2 and the barrel 10 are closed with covers 17, 18 and 19 respectively.

The larger diameter housing 1 has annular grooves 20, 21, and 22 and passages 23, 24, 25, 26 and 27. The passage 26 communicates with the branch pipe 28 wherethrough the pressure fluid is fed to the machine. The annular grooves 20, 21 and 22 are intended to pass the fluid and distribute it together with passages 25, 26 and the branch pipe 28 during forward and return strokes of the hammer piston 3 and the pusher piston 12 of the percussive and rotation mechanism respectively. The passages 23 and 24 are the discharge ones. The passage 23 serves both the percussive and the rotation mechanisms, while the passage 24, the rotation mechanism only.

The housing 2 has holes 29 which connect the supply space 29*a* of the housing 2 which is not subject to the fluid pressure with the atmosphere to rule out formation of a water cushion in said space due to seepage of the pressure fluid through the packing glands from the inside of the machine; otherwise, said fluid might retard the movement of the hammer piston 3 during the return stroke thereof.

The middle annular groove 21 of the housing 1 is constantly communicating via the passages 25 with the larger chamber 14 of the cylinder 9, while the rear annular groove 22 is constantly communicating between the passage 26 with the smaller chamber 13 of said cylinder and via the branch pipe 28, hose 30 (shown in a dot-and-dash line) and, branch passages 31, 32 with the pressure pipeline (not shown). (Similar passages 25 and 26 are provided to permit communication between annular slots 21 and 22 and the chambers 13 and 14 of the second cylinder 9).

Fitted over the hammer piston 3 in the housing 1 is a stepped pressure difference ring valve 33 with an inner eccentric annular projection 34, passages 35 and outer annular groove 36.

The front portion of the hammer piston 3 has an annular projection 37; the rear thinned portion thereof has an end face 4. The rear portion of the hammer piston with the end face 4 is located in the space 38 of the cover 18.

The inner annular projection 34 of the valve 33 is offset from the machine, longitudinal axis and its internal diameter exceeds the diameter of the annular projection 37 of the hammer piston 3 by the run fit clearance. This is done to ensure that the valve 33 is fitted through the annular projection 37 to the thinned portion of the hammer piston 3 outside the machine but does not slip off from said portion during operation of the assembled machine by engaging the projection 37 of the hammer piston with its projection 34.

Inasmuch as the valve 33 is made with the eccentric projection 34, the hammer piston 3 separates the valve 33 from the anvil 6 at the end of its return stroke.

The passages 35 are made in the valve 33 to admit the fluid pressure to the return space of the housings 1 and 2 to effect a return stroke of the hammer piston 3.

The middle thinned part of the differential pusher piston 12 is arranged in the barrel 10 eccentrically to its axis. This is done to prevent turning of the pusher piston in the barrel 10. To enable fitting of the partition 11 on the thinned part of the pusher piston 12, said partition is comprised of two diametrical parts.

Water for washing the well is fed through the branch pipe 39, axial passage 40 of the anvil 6, passage of the rod 7 and then through the tool to the well bottom (not shown).

The supply space 41 of the cylinder 9 communicates with the atmosphere via the passage 42. The barrel 10 of the cylinder 9 has annular grooves 43, 44 and passages 45, 46 adapted to admit the fluid to the chambers 13 and 14 respectively.

The profile of the tooth 16 of the gear 18 may be of an equilateral triangle shape, as shown in FIG. 2, or of a scalene triangle, as shown in FIG. 3.

A hydraulic percussive-rotary machine, as shown in FIGS. 4 through 9, with a reversible rotation mechanism has the same percussive mechanism as the machine shown in FIGS. 1 and 2, while the rotation mechanism is provided additionally with two similar twin cylinders. Inasmuch as said additional twin cylinders have the same design as the twin cylinders 9 their parts are designated in the specification and drawings with the same reference numerals supplemented with index *a*.

The additional twin cylinder 9*a* (FIG. 5) is located opposite the cylinder 9 along a diagonal. The barrel 10*a* of the cylinder 9*a* is made integral with the barrel 10 of the cylinder 9. The rotation mechanism is also provided with a hydraulic cylinder 47 (FIG. 6) for alternately cutting in twin cylinders 9 or 9*a* whose body 48 is rigidly secured to the machine housing 1.

Each twin cylinder 9*a* of the reversible rotation mechanism has the barrel 10*a* divided by a lateral partition 11*a* and a differential pusher piston 12*a* with a thinned middle part passing through the partition 11*a* forms therewith and with the barrel 10*a* two chambers 13*a* and 14*a*. The chambers 13*a* section area is smaller than that of the chamber 14*a*. The pusher piston 12*a* carries a spring-loaded pawl 15*a* meshed with the teeth 16 of the gear 8 during the forward stroke of the pusher piston which turns reversibly the anvil 6 with the rod 7 and the tool.

The body 48 (FIG. 6) of the hydraulic cylinder 47, which is closed at one side with a nut 49, has passages 50 and 51 communicating respectively via passages 50*a* (FIG. 4) and 51*a* (FIGS. 4, 6) with the annular grooves 21 and 22, passages 52 and 53 (FIG. 6) communicating respectively via passages 52*a* and 53*a* with the larger chambers 14 (FIG. 5) of one pair of diagonal cylinders 9, and passages 54 and 55 (FIG. 6) communicating via passages 54*a* and 55*a* with the larger chambers 14*a* (FIG. 5) of the other pair of diagonal cylinders 9*a*.

The above-mentioned passages 50, 50*a*, 51, 51*a* 52, 52*a* 53, 53*a* 54, 54*a*, 55, and 55*a* are intended to admit the fluid to the larger chambers 14 and 14*a* of the respective cylinders 9 and 9*a*.

To deliver the fluid to the respective smaller chambers of the twin hydraulic cylinders 9 and 9*a* (FIG. 5) use is made of the passages 26 and 26*a* (FIG. 6) which connect constantly the smaller chambers 13 and 13*a* (FIG. 5) with the pressure pipeline via the annular groove 22.

The body 48 (FIG. 6) is also provided with a branch passage 56 connected to the pressure pipeline via a hose 57 (shown by a dot-and-dash line) and a starting cock 58 having distribution passages 59 and 60 and accommodated in a body 61. The body 61 of the cock 58 is linked by a hose 62 (shown in a dot-and-dash line) with the branch pipe 32 (FIG. 4) and then via the branch pipe 31 and 30 (shown in a dot-and-dash line) with the branch passage 28.

The body 48 (FIG. 6) of the hydraulic cylinder 47 houses a slide valve 63 adapted to move axially and pressed from one side with a spring 64.

The slide valve 63 has three annular outer grooves 65, 66, and 67 serving as passages, of which the grooves 65 and 67 are interconnected by passages 68 made in the slide valve 63.

Figure 5:
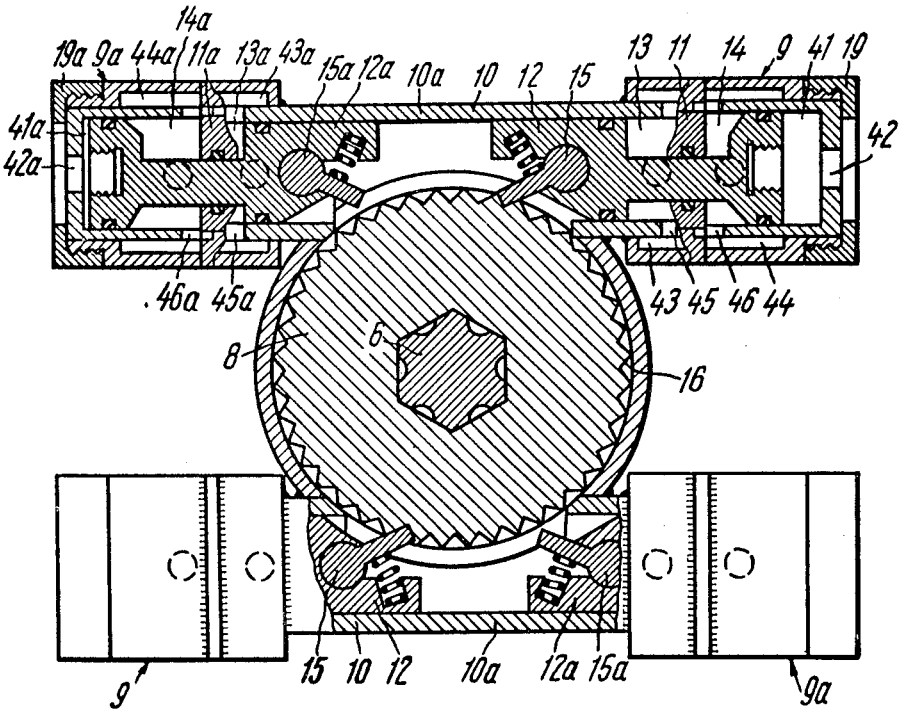
FIG. 5 is a cross sectional view taken along the line V—V of FIG. 4.
Figure 6:
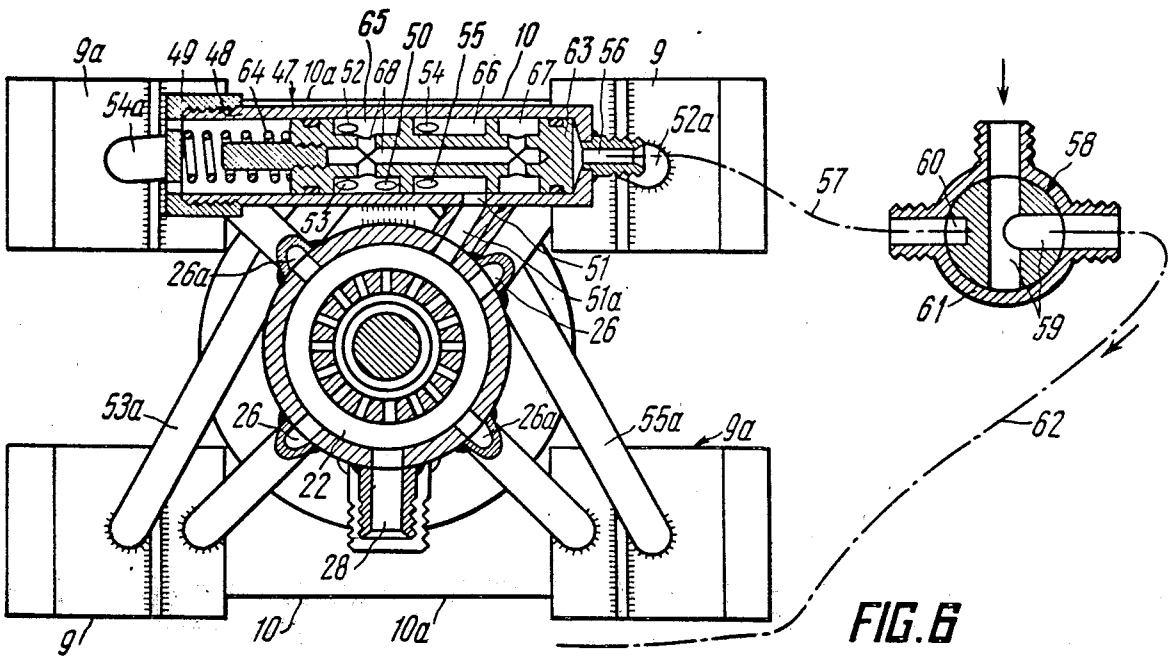
FIG. 6 is a cross sectional view taken along the line section VI—VI of FIG. 4, wherein the position of the slide valve and starting cock corresponds to the direction of rotation of the drill when drilling the well.
Figure 7:
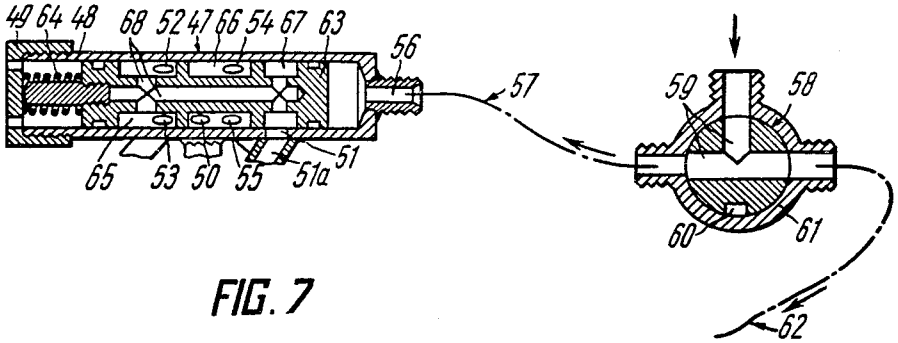
FIG. 7 is a cross sectional view showing the position of the slide valve and starting cock corresponding to the direction of rotation of the drill when turning out the string of drilling pipes (reversed rotation)

The slide valve 63 is intended when being in one extreme position shown in FIG. 6 to cut in for operation one pair of the diagonal cylinders 9 pusher pistons 12 and cut off the second pair of pusher pistons 12*a* of the cylinders 9*a* and when being in the other extreme position shown in FIG. 7 to cut off the first pair of the pusher pistons 12 of the cylinders 9 and cut in the second pair of the pusher pistons 12 of the cylinders 9*a*. Operation of the first pair of the pusher pistons 12 of the cylinders 9 results in rotation of the gear 8 with the anvil 6 and rod 7 to one side (counterclockwise, FIG. 5), while operation of the second pair of the pusher pistons 12*a* of the cylinders 9*a* reverses the rotation of said parts (clockwise, FIG. 5).

The slide valve is shifted to the extreme position to the pusher pistons 12 operate by the compression spring 64 (FIG. 6), and to the other extreme position to the pusher pistons 12*a* operate by the starting cock 58 which feeds the pressure fluid to the slide valve 63 end face opposite to the spring loaded face. The pressure fluid shifts the slide valve 63 to the opposite extreme position (FIG. 7) thus compressing the spring 64.

With the slide valve spring 64 released, as shown in FIG. 6, the annular groove 65 communicates via the passages 52, 52*a* and 53, 53*a* respectively with the larger chamber 14 of each diagonal cylinder 9, and via the passages 50, 50*a* (FIG. 4) with the annular groove of the housing 1 connected periodically with the discharge passage 23 of the machine. The middle annular groove 66 (FIG. 6) communicates via the passages 51 and 51*a* with the annular groove 22 of the cylinder 1 and then via the passage 28, hose 30 (FIG. 30), branch passages 31 and 32, hose 62 and distribution passages 59 of the valve 58 with the pressure pipeline (not shown). Further, said groove 66 is connected by the passages 54, 54*a* and 55, 55*a* (FIG. 6) respectively with the larger chamber 14*a* of each of the two diagonal cylinders 9*a*.

Figure 4:
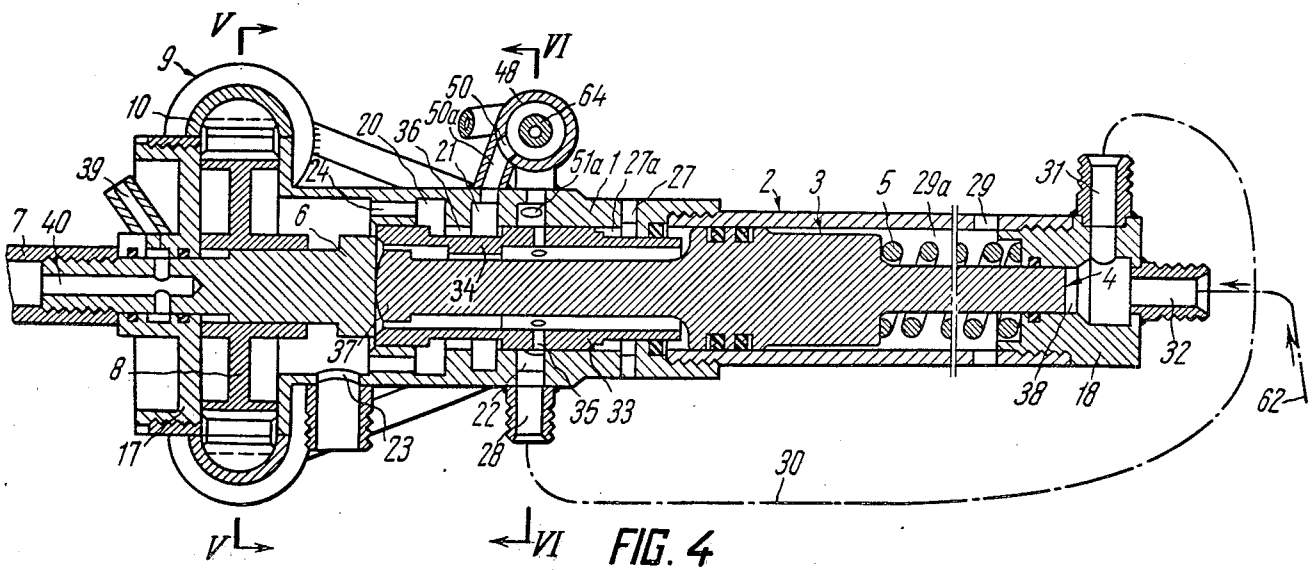
FIG. 4 is a longitudinal sectional view of a hydraulic percussive-rotary machine, according to the invention, with a reversible independent drill turning.

As seen from FIGS. 4 and 6 the smaller chambers 13 and 13*a* of the respective cylinders 9 and 9*a* are connected by the passages 26, 26*a*, 22, 28, hose 30, branch passages 31 and 32, hose 62, and passages 59 of the valve 58 with the pressure pipeline irrespective of the position of the slide valve 63. The action of the pressure fluid is shown in FIGS. 4 and 6 by arrows.

The operation of the hydraulic percussive-rotary machine is described hereinbelow in succession; first is described operation of the machine with a unidirectional turn of the drill pipes (FIGS. 1, 2), and then with a reversible turn of the drill pipes (FIGS. 4–7).

The position of the hydraulic percussive machine shown in FIGS. 1 and 2 is assumed to be the initial one.

In this position the machine valve 33 is pressed against the anvil 6 thus closing the fluid inside the return space. The holes 35 of the valve 33 are opposite the annular groove 22, thus connecting the return space of the housings 1 and 2 via the passages 35, 22, 26 and 28, hose 30, branch pipes 31 and 32 and a hose (not shown) fitted over the branch pipe 32 with the pressure pipeline.

The smaller chamber 13 of each cylinder 9 is also connected to the pressure pipeline by the passages 26.

The pressure fluid from the pipeline (or pump) is fed through the branch pipe 32 to the supply chamber 38 and via the branch pipe 31, hose 30, branch pipe 28 and passages 22 and 35 to the return space of the housings 1 and 2 and via the passages 26, 43 and 45 to each supply chamber 13 of the pusher piston 12, 12*a*.

The pressure fluid shifts the hammer piston 3 towards the rear portion of the machine (rightward in the drawing), since the areas of the hammer piston end faces acted upon by the fluid differ (the head face area exceeds the tail face one) and a part of the area not subjected to the pressure is located in the annular gap 29*a* of the housing 2 which is communicated with the atmosphere via the holes 29.

Synchronously with the above-disclosed return stroke of the hammer piston 3, the pusher pistons 12 effect a forward stroke to turn the gear 8 by means of the pawls 15 meshed at this period with the gear 8, hence the anvil 6 and the rod 7 with the tool twin through a preset angle counterclockwise (FIG. 2). The fluid is expelled from the chamber 14 by the larger diameter step of the pusher piston 12 via the passages 46, 44, 25 21, 36, 24 and 23 to the atmosphere.

After passing through the required distance and compressing the spring 5, the hammer piston 3 engages by its annular projection 37 the internal eccentric annular projection 34 of the valve 33 and separates the valve 33 from the anvil 6 thus opening the annular gap between the anvil 6 and the cylinder 1 to release the fluid from the return space. The valve 33 keeps on moving towards the rear portion of the machine independently due to the differential shape thereof and the annular gap 27*a* in the housing 1 not compensated by the pressure and communicated via the holes 27 with the atmosphere. During this movement of the valve 33 holes 35 are offset from the annular groove 22 and are overlapped, the annular gap 36 of the valve 33 interconnects the annular grooves 21 and 22, while the grooves 20 and 21 get disconnected due to displacement of the annular groove 36 of the valve 33 backwards to the rear portion of the machine. The pressure fluid enters the chambers 13 and 14 of the cylinders 9 via the passages 22, 36, 21, 25, 26, 43, 45, 44, and 46, and inasmuch as the chamber 14 section area exceeds that of the chamber 13, the fluid pressure in each chamber 14 makes the pusher pistons 12 move backwards away from the gear 8 unmeshing their pawls 15 from the gear 8 which remains stationary due to the axial feed force. The hammer piston 3 stops, as well as the fluid column in the hose thereabove, and a hydraulic shock occurs.

The combined action of the hydraulic shock, excess pressure of the fluid on the end face 4 and of the releasing spring 5 the hammer piston 3 rushes forward (leftward in the drawing) expelling the fluid from the return space outside through the open annular gap between the cylinder 1 and the anvil 6 and through the discharge passage 23. The hammer piston 3 meets the valve 33 approaching by the action of the discharge fluid, carries the valve along, applies impact to the anvil 6 secured via the drill rod 7 with the tool, and presses the valve 33 to the anvil 6 (this position is shown in FIG. 1), thus ceasing the expelling the fluid outside from the return space; the fluid column in the supply hoses stops again and a hydraulic shock occurs which is transmitted through the holes 35 aligned with the annular groove 22 in the foremost (in the direction to the tool) position of the valve 33 to the return space.

The hydraulic shock and the excess pressure force moves the hammer piston 3 backward while the pusher pistons 12 effect the forward strokes thereof turning the gear 18 by their pawls 15 through a preset angle and the cycle repeats.

When providing an additional pair of twin cyclinders 9*a* and a hydraulic cylinder 47 connected to the passages and spaces of the machine housings 1 and 2, as described above and shown in FIGS. 4–7, the drill rods 7 may be rotated reversibly.

With the slide valve spring 64 (FIG. 6) released in a hydraulic percussive machine with such a reversible rotation mechanism, the pressure fluid constantly fills both the chambers 13*a* and 14*a* of each cylinder 9*a*, and due to the difference of the section areas of said chambers 13*a* and 14*a* the pusher pistons 12*a* are force away by the pressure fluid from the gear 8 and operate synchronously with the displacements of the valve 33 to turn the gear 8 with the anvil 6 and the drill rod 7 (counterclockwise in FIG. 5) by means of the pawls 15 during the return stroke of the hammer piston 3.

With the slide valve spring 64 compressed through the value of the slide valve 63 travel (FIG. 7), which is accomplished by turning the valve 58 through 90° counterclockwise, and by the action of the pressure fluid through the passages 59 and 57 and, branch passage 56 to the slide valve 63, the extreme annular grooves 65 and 67 of the slide valve 67 interconnected by the passages 68 communicate (FIG. 4) via the passages 51*a*, 22 and 28, hose 30, branch passages 31 and 32 and hose 62, passages 59 (FIG. 7) of the valve 58 with the pressure pipeline and via the passages 52, 52*a* and 53, 53*a* (FIG. 6) respectively with the larger chambers 14 of the diagonal cylinders 9, while the middle annular groove 66 of the slide valve 63 communicates via the passages 54, 54*a* and 55, 55*a* with the respective larger chambers 14*a* of the second pair of the pusher pistons 12*a* and via the passages 50 and 50*a* with the annular groove 21 of the cylinder 1 which is periodically connected to the discharge passage 23 of the machine. The action of the pressure fluid is shown in FIG. 7 by arrows.

Due to the above, the second pair of the pusher piston 12*a* with the pawls 15*a* starts operating synchronously with the displacement of the valve 33, while the first pair of the pusher pistons 12 gets forced away from the gear 8. Now the gear 8 with the anvil 6 and rod 7 is rotated in the opposite direction (clockwise in FIG. 5).

The reversible rotation is necessary for turning out the drill rods.

The present percussive machine both with the unidirectional and reversible rotation of the drilling tool will operate successfully without a spring or any other resilient member between the hammer piston 3 and the cover 18 of the housing 2, which however reduces the machine efficiency.

Figure 8:
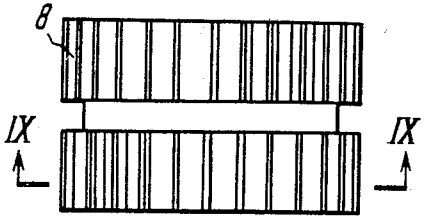
FIG. 8 is a possible design of a gear of the rotation mechanism shown in FIGS. 4 and 5.
Figure 9:
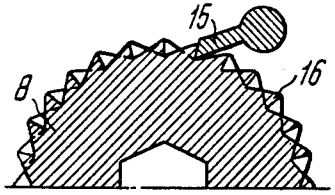
FIG. 9 is a cross sectional view taken along the line IX—IX of FIG. 8 showing the position of a pawl meshing with a tooth.

FIGS. 8 and 9 show one of the possible designs of the gear 8 of the rotation mechanism with the pawl 15 of the pusher piston, wherein the pawl meshes with the tooth 16 having a scalene triangle profile.

Figure 10:
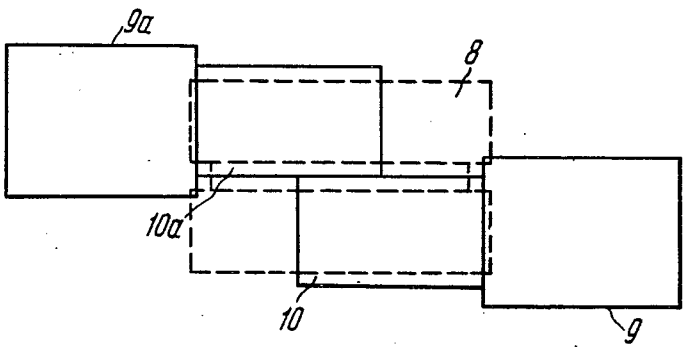
FIG.10 is a possible variant of the arrangement of the cylinders of the rotation mechanism shown in FIGS. 4 and 5 when making a gear tooth profile as a scalene triangle.

FIG. 10 shows one of the possible arrangements of the cylinder 9, 9*a* of the reversible rotation mechanism which are shown in FIGS. 4, 5 when making the gear 8 tooth 16 profile as a scalene triangle.

What is claimed is:

1. A hydraulic percussive-rotary machine for drilling holes and deep wells comprising: a housing with passages for fluid; a stepped hammer piston adapted to move axially in said housing and reciprocating to effect forward and return strokes and to apply impacts during the forward strokes at an anvil which mounts a tool; a stepped pressure difference ring valve with an outer annular groove, fitted over said hammer piston and also reciprocating to distribute the fluid between the return space of said housing and the atmosphere; a gear mounted on said anvil; a tool rotation mechanism linked kinematically with said gear; said tool rotation mechanism including at least one twin hydraulic cylinder comprised of two different diameter cylinders, arranged in the front portion of said housing of the machine, divided by a lateral partition and accommodating a pusher piston which carries a spring-loaded pawl and forms with the partition and the cylinder barrel two chambers, a smaller diameter chamber and a larger diameter chamber; at the point of location of said ring valve, said housing of the machine being provided with three inner annular grooves, of which the front groove, as in the direction of drilling, communicates via the passage of said housing of the machine with the atmosphere, the middle groove communicates constantly via the passage of said housing with the larger diameter chamber of said twin hydraulic cylinder, while the rear groove communicates via the passages of said housing with the smaller diameter chamber of said twin hydraulic cylinder and with the pressure pipeline; so that during reciprocation of said ring valve, the pusher piston of said twin hydraulic cylinder effects return and forward strokes thus kinematically interacting via the pawl with said gear to turn the latter together with said anvil and rod and with said tool during a return stroke of said hammer piston.

2. A hydraulic percussive-rotary machine for drilling holes and deep wells, comprising: a housing with passages for fluid; a stepped hammer piston adapted to move axially in said housing and reciprocating to effect forward and return strokes and to apply impacts during the forward strokes to an anvil which mounts a tool; a stepped pressure difference ring valve with an outer annular groove, fitted over said hammer piston and also reciprocating to distribute the fluid between the return space of said housing and the atmosphere; a gear mounted on said anvil; a tool rotation mechanism linked kinematically with said gear; said tool rotation mechanism linked kinematically with said gear; said tool rotation mechanism including at least one twin hydraulic cylinder comprised of two different diameter cylinders, arranged in the front portion of said housing of the machine, divided by a lateral partition and accommodating a pusher piston which carries a spring-loaded pawl and forms with the partition and the cylinder barrel two chambers, a smaller diameter chamber and a larger diameter chamber; at the point of location of said ring valve said housing of the machine being provided with three inner annular grooves, of which the front groove, as in the direction of drilling, communicates via the passage of said housing of the machine with the atmosphere, the middle groove communicates constantly via the passage of said housing with the larger diameter chamber of said twin hydraulic cylinder, while the rear groove communicates via the passages of said housing of the machine with the smaller diameter chamber of said twin hydraulic cylinder and with pressure pipeline; so that during reciprocation of said ring valve, the pusher piston of said twin hydraulic cylinder effects forward and return strokes thus kinematically interacting via the pawl with said gear to turn the latter together with said anvil and rod and with said tool during a return stroke of said hammer piston; at least one additional twin hydraulic cylinder, connected to the passages of said housing of the machine similar to said main twin hydraulic cylinder, arranged at the opposite side of said gear with respect to said main twin hydraulic cylinder; a hydraulic cylinder connected to said main and additional twin hydraulic cylinders and to the grooves of said housing of the machine and adapted to alternately cut in and cut out said main and additional twin hydraulic cylinders; thus enabling said hydraulic percussive-rotary machine to effect both a direct rotation of the rods with tool at drilling and a reversed rotation thereof for turning out the rods after drilling that considerably increases the machine efficiency when drilling deep wells.

* * * * *